US009622299B2

(12) United States Patent
Hatano

(10) Patent No.: US 9,622,299 B2
(45) Date of Patent: Apr. 11, 2017

(54) DISPLAY DEVICE

(71) Applicant: NICHIA CORPORATION, Anan-shi (JP)

(72) Inventor: Tomohiko Hatano, Naruto (JP)

(73) Assignee: NICHIA CORPORATION, Aichi-shi (JP)

( * ) Notice: Subject to any disclaimer, the term of this patent is extended or adjusted under 35 U.S.C. 154(b) by 201 days.

(21) Appl. No.: 14/711,778

(22) Filed: May 14, 2015

(65) Prior Publication Data

US 2015/0341992 A1 Nov. 26, 2015

(30) Foreign Application Priority Data

May 26, 2014 (JP) ..... 2014-107677

(51) Int. Cl.

| | |
|---|---|
| ***H05B 33/04*** | (2006.01) |
| ***H05B 33/12*** | (2006.01) |
| ***G09F 9/33*** | (2006.01) |
| ***G09F 7/00*** | (2006.01) |

(52) U.S. Cl.

CPC ..... *H05B 33/04* (2013.01); *G09F 7/002* (2013.01); *G09F 9/33* (2013.01); *H05B 33/12* (2013.01)

(58) Field of Classification Search

CPC ..... H05B 33/04; H05B 33/12; G09F 7/002; G09F 9/33

See application file for complete search history.

(56) References Cited

U.S. PATENT DOCUMENTS 8,172,097 B2 * 5/2012 Nearman ..... G09F 9/33 211/189

FOREIGN PATENT DOCUMENTS

| | | |
|---|---|---|
| JP | 8-234671 | 9/1996 |
| JP | 2004-37707 | 2/2004 |
| JP | 2005-57073 | 3/2005 |
| JP | 2010-181721 | 8/2010 |
| JP | 2013-30401 | 2/2013 |

* cited by examiner

*Primary Examiner* — Donald Raleigh
*Assistant Examiner* — Kevin Quarterman
(74) *Attorney, Agent, or Firm* — Mori & Ward, LLP

(57) ABSTRACT

A display device includes a substrate, a mask, a case, and a sealing member. The mask has a mask surface and a side wall provided around a periphery of the mask surface and projecting backwardly from the mask surface. The mask is provided on a front surface of the substrate so that the mask surface faces the front surface of the substrate and the side wall surrounds a side surface of the substrate. The case is provided on a back surface of the substrate to sandwich the substrate between the mask and the case. The sealing member is provided in a first region, a second region, and a third region provided between the first region and the second region. The sealing member has a first protrusion which is in contact with a step end surface of the case in the third region.

21 Claims, 4 Drawing Sheets

40
50
30
X
X 100
30
30a
30b 30
50
40

DISPLAY DEVICE

CROSS-REFERENCE TO RELATED APPLICATIONS

The present application claims priority under 35 U. S. C. §119 to Japanese Patent Application No. 2014-107677, filed May 26, 2014. The contents of this application are incorporated herein by reference in their entirety.

BACKGROUND (1) Technical Field

The present disclosure relates to a display device.

(2) Description of the Related Art

Conventionally, in a display device that has a substrate with a plurality of light-emitting elements mounted thereon, it has been proposed that a sealing member is interposed between a mask covering the substrate and a case for purpose of waterproof.

SUMMARY OF THE INVENTION

According to one aspect of the present invention, a display device includes a substrate, a mask, a case, and a sealing member. The substrate has a front surface, a back surface opposite to the front surface, and a side surface between the front surface and the back surface. The substrate includes light-emitting elements provided on the front surface. The mask has a mask surface and a side wall provided around a periphery of the mask surface and projecting backwardly from the mask surface. The side wall has an inner peripheral side surface and a rear end surface. The mask is provided on the front surface of the substrate so that the mask surface faces the front surface of the substrate and the side wall surrounds the side surface of the substrate. The case has an inner peripheral wall protruding forwardly from a step end surface of the case. The inner peripheral wall has an outer peripheral side surface and a forward end surface. The case is provided on the back surface of the substrate to sandwich the substrate between the mask and the case. The outer peripheral side surface faces the inner peripheral side surface of the mask to define a first region between the outer peripheral side surface and the inner peripheral side surface of the mask. The step end surface faces the rear end surface of the mask to define a second region between the step end surface and the rear end surface of the mask. The sealing member is provided in the first region, the second region, and a third region provided between the first region and the second region. The sealing member has a first protrusion which is in contact with the step end surface of the case in the third region.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figures 1A, 1B, 1C:
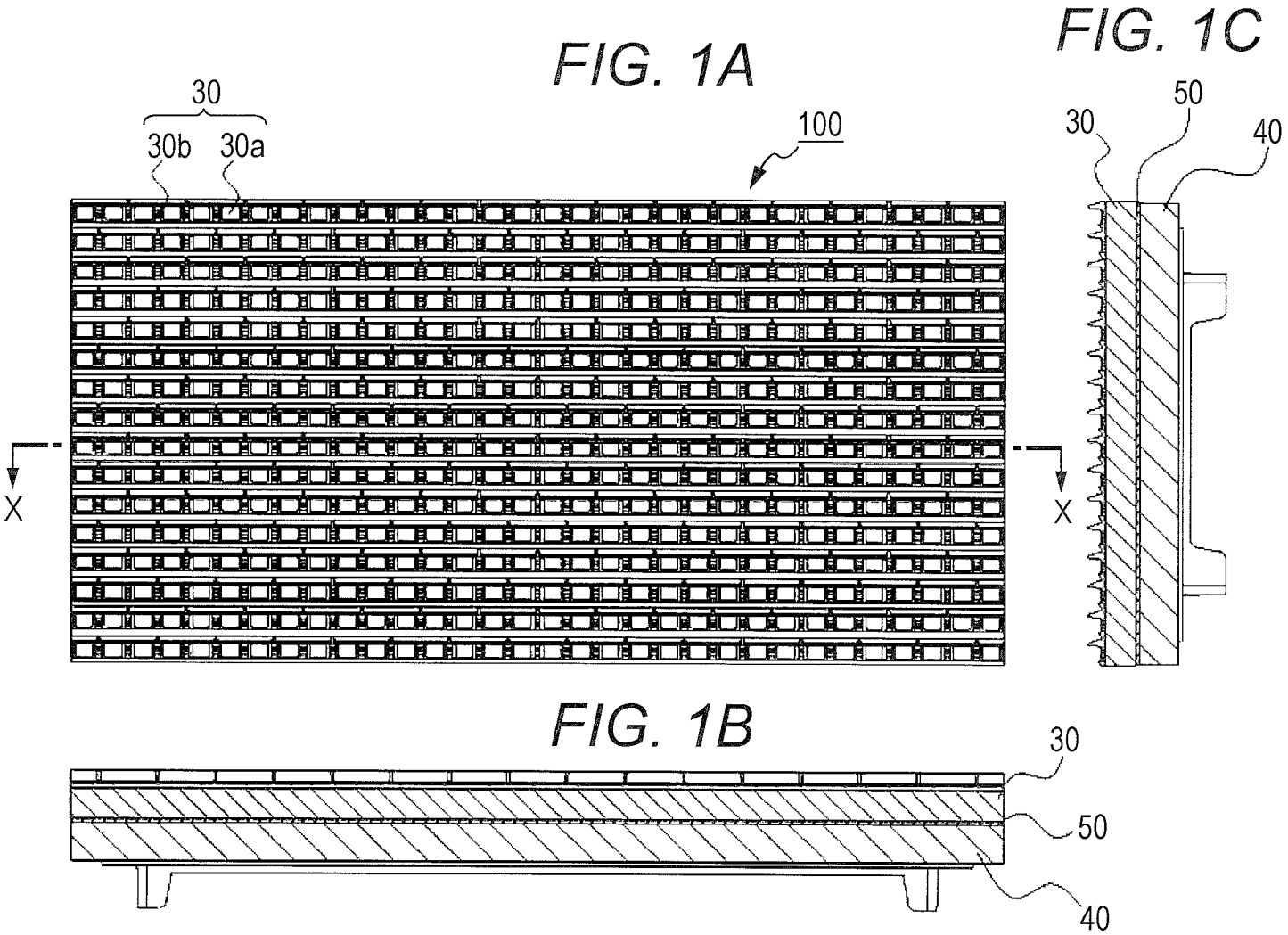
FIGS. 1A to 1C are pattern diagrams of a display device according to an embodiment of the present invention.

The embodiments will now be described with reference to the accompanying drawings, wherein like reference numerals designate corresponding or identical elements throughout the various drawings.

An embodiment of the present invention will be described below with reference to the drawings. However, the following embodiment is intended to illustrate a display device for embodying the technical idea of the present disclosure, and the dimensions, materials, shapes, relative configuration, etc. are not intended to limit the scope of the present invention only thereto, but merely by way of examples for the purpose of explanation.

Figure 2:
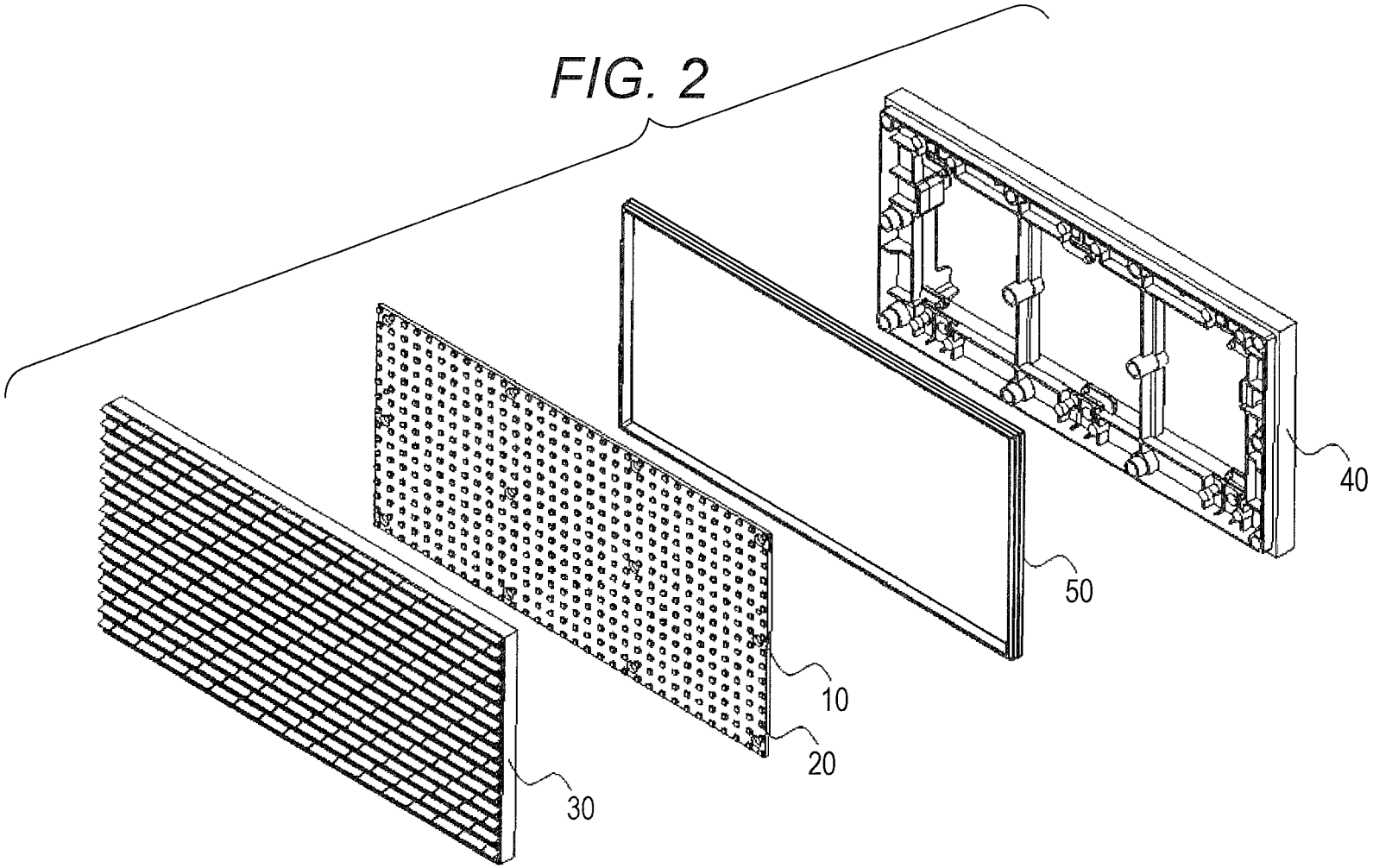
FIG. 2 is a perspective view for illustrating the appearance of the display device according to the embodiment of the present invention.
Figure 3:
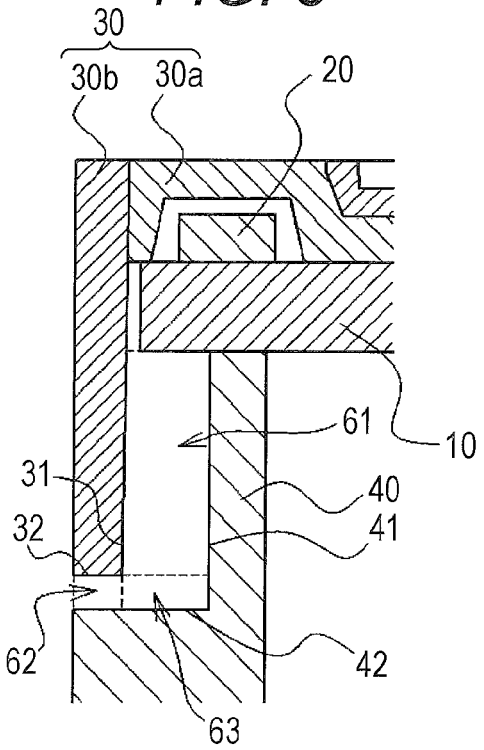
FIG. 3 is a fragmentary end view illustrating an example of an end view of the display device according to the embodiment of the present invention.
Figure 4:
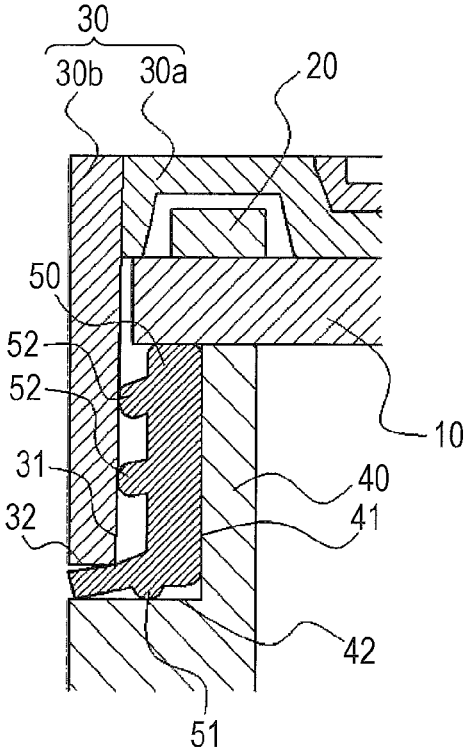
FIG. 4 is a fragmentary end view for illustrating the display device according to the embodiment of the present invention.
Figure 5:
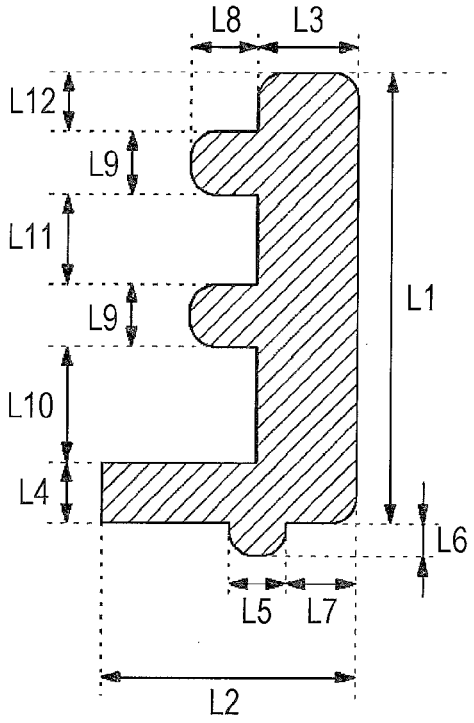
FIG. 5 is an end view of a sealing member provided in a light-emitting device according to the embodiment of the present invention.
Figure 6:
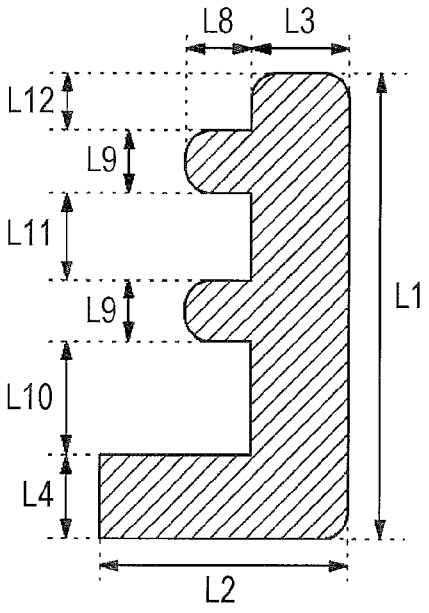
FIG. 6 is an end view of a sealing member provided in a light-emitting device according to a comparative example.

FIGS. 1A to 1C are diagrams of a display device according to the present embodiment, where FIG. 1A is a plan view, FIG. 1B is a side view in the longitudinal direction of the display device, and FIG. 1C is a side view in the width direction of the display device. FIG. 2 is an exploded view for illustrating the schematic configuration of the display device obtained according to the present embodiment. FIG. 3 is an end view of a left-hand end along the line X-X in FIG. 1A, for illustrating a region formed from constituent elements of the display device. FIG. 4 is an end view of a left-hand end along the line X-X in FIG. 1A. FIG. 5 is an end view for illustrating the shape of a sealing member used in an example according to the embodiment of the present invention. FIG. 6 is an end view for illustrating the shape of a sealing member used in a display device according to a comparative example.

The display device according to the present embodiment includes, as shown in FIG. 4, a substrate 10 with a plurality of light-emitting elements 20 front-mounted thereon, a mask 30 that covers the substrate 10 at a front side of the substrate, and a case 40 that supports the substrate 10 at a back side of the substrate 10. Further, the mask 30 includes a sidewall projecting from a periphery of the mask 30 toward the back side of the substrate 10 and having an M1 surface 31 (an inner peripheral side surface) that faces inward and an M2 surface 32 (a rear end surface) that faces backward, the case 40 includes a C1 surface 41 (an outer peripheral side surface) facing the M1 surface 31, and a C2 surface 42 (a step end surface) facing the M2 surface 32. A sealing member 50 is provided in an A1 region 61 (a first region) between the M1 surface 31 and the C1 surface 41, an A2 region 62 (a second region) between the M2 surface 32 and the C2 surface 42, and an A3 region 63 (a third region) connecting the A1 region 61 and the A2 region 62, and the sealing member 50 has a first protrusion 51 in contact with the C2 surface 42 in a position opposed to the C2 surface 42 in the A3 region 63.

In general, the interposition of the sealing member between the mask and the case in the periphery of the display device can provide the display device itself with a waterproof property. However, just tightly sandwiching the sealing member in the A2 region can ensure a waterproof property, but the mask may be slightly deformed by a repulsion force of the sealing member in some cases. This deformation partially disturbs the positional relationship between the light-emitting elements and the mask, and thus, when the display device is viewed from the visible side with the light-emitting elements turned on, brightness of the display device may be uneven depending on a viewing position (hereinafter, referred to as "impairment of visibility" for the sake of convenience). Specifically, the sealing member pushes the mask forward in the A2 region to slightly raise the periphery of the mask, and as a result of the narrowed angle of light distribution in the region, the periphery of the display device may appear darker than the inner part thereof when the display device is viewed from an obliquely front side of the display device. On the other hand, in the case where the sealing member is loosely sandwiched in the A2 region, impairment of visibility due to a deformation of the mask can be suppressed, but in this case, the display device is inferior in waterproof property.

Therefore, in the present embodiment, not in the A2 region 62 but in the A3 region 63, the sealing member 50 has the first protrusion 51 in a position facing the C2 surface 42 of the case. Providing the first protrusion 51 not in the A2 region 62 but in the A3 region 63 can ensure at least a certain level of waterproof property in the A2 region 62, even in the case where the sealing member 50 is loosely sandwiched in the A2 region 62. Thus, according to the present embodiment, impairment of visibility can be suppressed while ensuring a waterproof property.

The main structural components of the display device will be described below with reference to the drawings.

Substrate 10

The substrate 10 has a plurality of light-emitting elements 20 front-mounted thereon, and has a shape of a substantially flat plate. In addition, a glass epoxy substrate, a glass composite substrate, or the like can be used as the substrate 10. The dimensions of the substrate 10 can be adapted to, for example, 50 mm to 150 mm in vertical dimension, 150 mm to 250 mm in horizontal dimension, and 1.5 mm to 2.5 mm in thickness. In addition, on the substrate 10, a wiring is formed for supplying electricity to the light-emitting elements 20.

Surface-mount LEDs or the like can be used as the light-emitting elements 20. The dimensions of the light-emitting elements 20 can be, for example, 1.0 mm to 3.0 mm in vertical dimension, 1.0 mm to 3.0 mm in horizontal dimension, and 0.5 mm to 2.5 mm in thickness.

The plurality of light-emitting elements 20 mounted on the substrate 10 can be mounted on the substrate 10, for example, at an interval of 3 mm to 20 mm, preferably at an interval of 3 mm to 10 mm, further preferably at an interval of 4 mm to 8 mm. The interval between the light-emitting elements 20 herein means the distance between the centers of two adjacent light-emitting elements 20. Furthermore, in general, as a method for mounting the plurality of light-emitting elements 20 with a narrow interval to maintain broad light distribution characteristics, the thickness of the mask 30 described later can be reduced to shorten the distance between the front surfaces of the light-emitting elements 20 and the front surface of the mask 30. This can reduce light blocked out by the mask, and maintain broad light distribution characteristics, while the thinned mask 30 may undergo a decrease in strength and a deformation may likely to be caused. However, in the present embodiment, the deformation of the mask 30 can be suppressed, so that broad light distribution characteristics can be maintained even in the case where the light-emitting elements 20 are mounted with a narrow interval.

Mask 30

The mask 30 covers, as shown in FIGS. 3 and 4, the substrate 10 at the front side of the substrate 10. In addition, the mask 30 has the sidewall extending from the peripheral edge of the mask 30 to the side posterior to the substrate 10, the sidewall of the mask 30 includes the M1 surface 31 that faces inward and the M2 surface 32 that faces backward. More specifically, the sidewall extending from the peripheral edge of the mask 30 to the side posterior to the substrate 10 includes the M1 surface 31 corresponding to an inner surface of the sidewall and the M2 surface 32 corresponding to a posterior end surface of the sidewall. In this case, the M1 surface 31 and the M2 surface 32 are formed continuously. In addition, the M1 surface 31 is preferably an inclined surface, so that the mask 30 can be easily removed from a mold in the case of manufacturing the mask 30 by injection molding or the like.

As shown in FIGS. 3 and 4, the M2 surface 32 is formed to be continuous to the outer wall of the mask 30. In addition, the shape of the mask 30 is not particularly limited as long as the mask 30 can cover the substrate 10, but in a planar view, can be, for example, rectangular as shown in FIGS. 1A to 1C.

The mask 30 has a part (a mask surface) covering the front of the substrate 10, which is preferably provided with a light-transmitting member 30*a* that allows transmission of light from the plurality of light-emitting elements 20 mounted on the substrate 10 and a light-blocking member 30*b* that blocks external light or the like. In the present embodiment, as shown in FIGS. 1A to 1C and FIG. 3, the light-transmitting member 30*a* is formed so as to correspond to the region where the light-emitting elements 20 are arranged, and the light-blocking member 30*b* is formed so as to surround each light-transmitting member 30*a*. This can prevent ingress of moisture from the front side of the display device, thereby making the display device excellent in waterproof property. Further, the mask 30 is provided on the front surface of the substrate 10 so that the mask surface faces the front surface of the substrate 10.

Polycarbonate resins, ABS resins, or the like can be used as the material constituting the mask 30. In the present embodiment, the light-transmitting member 30*a* is formed from a light-transmitting polycarbonate resin, whereas the light-blocking member 30*b* is formed from a polycarbonate resin containing a black pigment.

Case 40

The case 40 supports, as shown in FIGS. 3 and 4, the substrate 10 at the back side of the substrate 10. The case 40 has an inner peripheral wall protruding forwardly from the step end surface of the case. The inner peripheral wall has the outer peripheral side surface and a forward end surface. The case 40 is provided on the back surface of the substrate 10 to sandwich the substrate 10 between the mask 30 and the case 40. In addition, the case 40 has the C1 surface 41 facing the M1 surface 31 of the mask, and the C2 surface 42 facing the M2 surface 32 of the mask. The C1 surface 41 and the C2 surface 42 are formed continuously.

As shown in FIGS. 3 and 4, the C1 surface 41 is formed to be continuous to a surface of the case 40 (the forward end surface) in contact with the substrate 10, and the C2 surface 42 is formed to be continuous to the outer wall of the case 40. The forward end surface can contact the back surface of the substrate 10. The shape of the case 40 is not particularly limited, but can be, for example, a rectangular shape. In the present embodiment, as shown in FIGS. 1A to 1C and FIG. 2, the case 40 has a rectangular outline, which is formed so as to be substantially comparable in size to the outline of the mask 30.

Polycarbonate resins, ABS resins, or the like can be used as a material of the case 40. In the present embodiment, a polycarbonate resin containing a black pigment is used.

Six brackets can be disposed between the case 40 and the substrate 10. The brackets are intended to attach the display device according to the present embodiment to the outside, and configured so that screws are inserted from behind the display device and then the display device itself according to the present embodiment can be fixed to an outer wall or the like with the brackets. It is to be noted that in the present embodiment, the substrate 10 is fixed by being sandwiched between the case 40 and the mask 30, and fixed by the brackets fitted into the case 40.

Sealing Member 50

The sealing member 50 is, as shown in FIGS. 3 and 4, provided in the A1 region 61, which is a space between the M1 surface 31 of the mask and the C1 surface 41 of the case, the A2 region 62, which is a space between the M2 surface 32 of the mask and the C2 surface 42 of the case, and the A3 region 63, which is a space connecting the A1 region 61 and the A2 region 62. In this regard, in this specification, the sealing member 50 may not provide in completely over the entire respective regions of the A1 region 61, the A2 region 62, and the A3 region 63.

As shown in FIG. 3, the device is formed so as to space the M1 surface 31 from the C1 surface 41, and the M2 surface 32 from the C2 surface 42 when the substrate 10, the mask 30, and the case 40 are fixed, and the sealing member 50 is supposed to be provided between the spaced regions. More particularly, the sealing member 50 is supposed to be provided in the A1 region 61, the A2 region 62, and the A3 region 63. This can prevent ingress of water from the outside, and can make the display device excellent in waterproof property.

The sealing member 50 has the first protrusion 51 in a position facing the C2 surface 42 in the A3 region 63. In other words, the sealing member 50 has the first protrusion 51 projecting toward the C2 surface 42, on the inward side from the M1 surface 31 (closer to the C1 surface 41). In this regard, when the protrusion formed in the sealing member 50 is sandwiched in the A2 region 62, it is difficult to suppress the deformation of the mask 30, because it is not possible to reduce the force by which the sealing member 50 pushes the mask 30 forward. However, in the present embodiment, because the first protrusion 51 is not sandwiched in the A2 region 62, the force of pushing forward to the sidewall of the mask 30 can be reduced by elasticity of the sealing member 50, so that the deformation of the mask 30 can be suppressed.

The sealing member 50 preferably has a second protrusion 52 in contact with the M1 surface 31 in a position facing the M1 surface 31. In other words, the sealing member 50 preferably has the second protrusion 52 projecting toward the M1 surface 31 in the A1 region 61. In an embodiment of the present invention, as shown in FIG. 4, the sealing member 50 has two second protrusions 52 in contact with the M1 surface 31 in a position facing the M1 surface 31 in the A1 region 61. Thus, even with ingress of moisture, etc. from the space between the sealing member 50 and the M2 surface 32, the ingress of moisture can be prevented by the second protrusions 52 in contact with the M1 surface 31, and the display device can be thus made further excellent in waterproof property. In addition, in the A1 region 61, a region is formed in which the sealing member 50 and the M1 surface 31 are partially spaced, and the force of pushing outward to the sidewall of the mask 30 can be thus reduced by elasticity of the sealing member 50 to further suppress the deformation of the mask 30. In addition, when the M1 surface 31 is inclined as described above, the pushing force acting on the second protrusion 52 formed closer to the substrate 10, of the two second protrusions 52 formed in the sealing member 50, is larger than the pushing force acting on the second protrusion 52 formed closer to the C2 surface 42 as shown in FIG. 4.

The sealing member 50 is preferably spaced from the C2 surface on the inward side from the first protrusion 51. Thus, in the A3 region 63, the pushing force exerted on the C2 surface 42 by the sealing member 50 is concentrated on the first protrusion 51, and the waterproof property can be thus further improved.

While the position of the sealing member 50 in the A1 region 61 is not particularly limited, the sealing member 50 is provided so that a portion of sealing member 50 is brought into contact with the back surface (the side without the plurality of light-emitting elements 20 mounted) of the substrate 10 as shown in FIG. 4. Thus, the sealing member 50 is sandwiched between the back surface of the substrate 10 and the C2 surface 42, and the pushing force acting on the first protrusion 51 formed in the sealing member 50 can be thus further increased. Therefore, the adhesion between the C2 surface 42 and the first protrusion 51 of the sealing member 50 is further improved to make it possible to improve the waterproof property.

While the placement of the sealing member 50 is not particularly limited in the A2 region 62 as long as the waterproof property can be ensured by the sealing member 50 sandwiched between the M2 surface 32 and the C2 surface 42, the sealing member 50 can be provided, for example, so as to be brought into contact with an inner end of the M2 surface 32, and spaced from an outer end of the M2 surface 32 as shown in FIG. 4. This concentrates the pushing force exerted on the inner end of the M2 surface 32 by the sealing member 50, and ingress of water from the outside can be thus further suppressed.

The sealing member 50 may be provided so that an end of the sealing member 50 is brought into contact with the C2 surface 42 in the A2 region 62. In this case, the sealing member 50 and the C2 surface 42 are spaced in a region which is inner side than a portion where the end of the sealing member 50 and the C2 surface 42 are in contact, and outer side than the first protrusion 51. More specifically, the sealing member 50 has the first protrusion 51 and end in contact with the C2 surface 42. This can concentrate the pushing force exerted on the C2 surface 42 by the first protrusion 51 and the end of the sealing member 50, so that ingress of water from the outside can be suppressed. It is to be noted that the sealing member 50 may partially extend from the A2 region 62 toward the outside of the display device.

The sealing member 50 is preferably in surface contact with the C1 surface 41. The surface contact herein refers to 80% or more, preferably 90% or more of the surfaces in contact. The 80% or more surfaces in surface contact can improve the adhesion between the sealing member 50 and the C1 surface 41, and can make the display device excellent in waterproof property. It is to be noted that in a case where a part of the sealing member 50 in contact with the C1 surface 41 has the protrusion formed, the sealing member 50 and the C1 surface 41 may not brought into surface contact, so that the adhesion may be impaired and the waterproof property may be decreased.

The shapes of the first protrusion 51 and second protrusion 52 formed in the sealing member 50 are not particularly limited, but can be appropriately changed depending on the sizes of the respective members constituting the display device.

The size of the sealing member 50 is not particularly limited, and can be appropriately changed depending on the members constituting the display device. In the present embodiment, the size of the sealing member 50 is preferably formed to be larger than the distance from the substrate 10 to the C2 surface 32, or the distance from the M1 surface 41 to the C1 surface 31. Accordingly, the sealing member 50 is compressed to provide a repulsion force when the display device is provided with the sealing member 50, and thus the waterproof function can be improved.

Elastic materials, for example, synthetic rubber such as silicone rubbers and nitrile rubbers can be used for the sealing member 50. The sealing member 50 which uses the material mentioned above is elastic, and can be sandwiched to ensure the waterproof property.

EXAMPLE

Next, an example of a display device according to the embodiment will be described.

A plurality of light-emitting elements 20 are mounted on the front surface of the substrate 10. The dimensions of the substrate 10 is adapted to approximately 90 mm in vertical dimension, approximately 190 mm in horizontal dimension, and approximately 2 mm in thickness, and the dimensions of each light-emitting elements 20 is adapted to approximately 2 mm in vertical dimension, approximately 2 mm in horizontal dimension, and approximately 1 mm in height. The plurality of light-emitting elements 20 was mounted in a matrix form of 16 (vertical)×32 (horizontal) at an interval of approximately 6 mm.

The mask 30 is placed to correspond to the plurality of light-emitting elements 20 mounted on the substrate 10, and provided with the light-transmitting member 30*a* that allows transmission of light from the light-emitting elements 20, and the light-blocking member 30*b* that blocks out external light. In addition, the light-transmitting member 30*a* is formed from a light-transmitting polycarbonate resin, whereas the light-blocking member 30*b* is formed from a light-shielding polycarbonate resin containing a black pigment. The dimensions of the mask 30 are approximately 100 mm in vertical dimension, approximately 190 mm in horizontal dimension, and approximately 2 mm in thickness, whereas the light-transmitting member is formed in a matrix form of 16 (vertical)×32 (horizontal) at an interval of approximately 6 mm. In addition, the mask 30 is provided with a sidewall of approximately 1 mm in thickness extending approximately 6 mm backward from the peripheral edge of the mask 30.

The case 40 is placed on the back side of the substrate 10, and provided so as to support the substrate 10. The dimensions of the case 40 are adapted to approximately 95 mm in vertical dimension, approximately 190 mm in horizontal dimension, and approximately 6 mm in height.

The sealing member 50 is, as shown in FIG. 5, adapted to approximately 5 mm (L1) in vertical dimension and approximately 2 mm (L2) in horizontal dimension in a cross-sectional view, and adapted to approximately 1 mm (L3) in thickness in the longitudinal direction and approximately 0.7 mm (L4) in thickness in the lateral direction. The dimensions of the first protrusion 51 are approximately 0.3 mm (L6) in height and approximately 0.6 mm (L5) in width, and the first protrusion 51 is provided to be located in a position approximately 0.6 mm (L7) from the part in contact with the C1 surface 31. The dimensions of the second protrusions 52 is adapted to approximately 0.7 mm (L8) in height and approximately 0.5 mm (L9) in width. The second protrusions 52 are provided to be located in two positions: a position which is approximately 1 mm (L10) away from the portion in contact with the M2 surface 32; and a position approximately 0.5 mm (L12) away from the portion in contact with the substrate 10. The two second protrusions were provided to be approximately 1 mm (L11) spaced from each other.

The mask 30, the substrate 10, and the case 40 are screwed so that the sealing member 50 is interposed in the A1 region 61, the A2 region 62, and the A3 region 63. The screwed points are adjusted to 12 points: 3 (vertical)×4 (horizontal). As described above, the sealing member 50 was provided with the first protrusion 51 in a position opposed to the C2 surface 32. The display device according to the present example has succeeded in reducing a pushing force exerted on the mask 30 by the sealing member 50 to suppress deterioration of visibility, and in improving the waterproof property. Furthermore, the display device according to the present example has succeeded in being confirmed to be a highly waterproof display device, due to the fact that ingress of water into the display device is not observed even in an IPX5 waterproof test as an index of waterproof performance.

As shown in FIG. 6, a display device according to a comparative example has substantially the same configuration as the display device according to the present example, except that the first protrusion 51 is not provided, and that a sealing member is used which is larger in thickness (L4) in the lateral direction as compared with the example. It is to be noted that the thickness (L4) in the lateral direction in the comparative example is increased by about the volume of the first protrusion 51 in the example.

As for the display device according to the comparative example, ingress of water into the display device is observed in an IPX5 waterproof test as an index of waterproof performance. Moreover, due to the increased thickness (L4) in the lateral direction, the force exerted on the mask 30 by the sealing member is not able to be reduced, and it is believed that the mask 30 will be deformed to deteriorate the visibility.

While the embodiments and the examples of the present invention have been described above, the descriptions relates to an example of the present invention, and the present invention should not be limited by the descriptions in any way.

The embodiment of the present invention can provide a display device which has visibility deterioration suppressed by a sealing member interposed, while having a waterproof property.

Obviously, numerous modifications and variations of the present invention are possible in light of the above teachings. It is therefore to be understood that within the scope of the appended claims, the invention may be practiced otherwise than as specifically described herein.

What is claimed is:

1. A display device comprising:

a substrate having a front surface, a back surface opposite to the front surface, and a side surface between the front surface and the back surface, the substrate including light-emitting elements provided on the front surface;

a mask having a mask surface and a side wall provided around a periphery of the mask surface and projecting backwardly from the mask surface, the side wall having an inner peripheral side surface and a rear end surface, the mask being provided on the front surface of the substrate so that the mask surface faces the front surface of the substrate and the side wall surrounds the side surface of the substrate;

a case having an inner peripheral wall protruding forwardly from a step end surface of the case, the inner peripheral wall having an outer peripheral side surface and a forward end surface, the case being provided on the back surface of the substrate to sandwich the substrate between the mask and the case, the outer peripheral side surface facing the inner peripheral side surface of the mask to define a first region between the outer peripheral side surface and the inner peripheral side surface of the mask, the step end surface facing the rear end surface of the mask to define a second region between the step end surface and the rear end surface of the mask; and a sealing member provided in the first region, the second region, and a third region provided between the first region and the second region, the sealing member having a first protrusion which is in contact with the step end surface of the case in the third region.

2. The display device according to claim 1, wherein the sealing member has a second protrusion which is in contact with the inner peripheral side surface of the mask in the first region.

3. The display device according to claim 1, wherein the sealing member is spaced from the step end surface of the case between the first protrusion and the outer peripheral side surface of the case.

4. The display device according to claim 2, wherein the sealing member is spaced from the step end surface of the case between the first protrusion and the outer peripheral side surface of the case.

5. The display device according to claim 1, wherein the sealing member which is in contact with an inner end of the rear end surface of the mask is spaced from an outer end of the rear end surface of the mask, and wherein the inner end of the rear end surface of the mask is closer to the outer peripheral side surface of the case than the outer end of the rear end surface of the mask.

6. The display device according to claim 2, wherein the sealing member which is in contact with an inner end of the rear end surface of the mask is spaced from an outer end of the rear end surface of the mask, and wherein the inner end of the rear end surface of the mask is closer to the outer peripheral side surface of the case than the outer end of the rear end surface of the mask.

7. The display device according to claim 3, wherein the sealing member which is in contact with an inner end of the rear end surface of the mask is spaced from an outer end of the rear end surface of the mask, and wherein the inner end of the rear end surface of the mask is closer to the outer peripheral side surface of the case than the outer end of the rear end surface of the mask.

8. The display device according to claim 1, wherein the sealing member has a contact point at an end of the sealing member, the contact point being in contact with the step end surface of the case in the second region, and wherein the sealing member is spaced from the step end surface of the case in a region between the contact point and the first protrusion.

9. The display device according to claim 2, wherein the sealing member has a contact point at an end of the sealing member, the contact point being in contact with the step end surface of the case in the second region, and wherein the sealing member is spaced from the step end surface of the case in a region between the contact point and the first protrusion.

10. The display device according to claim 3, wherein the sealing member has a contact point at an end of the sealing member, the contact point being in contact with the step end surface of the case in the second region, and wherein the sealing member is spaced from the step end surface of the case in a region between the contact point and the first protrusion.

11. The display device according to claim 4, wherein the sealing member has a contact point at an end of the sealing member, the contact point being in contact with the step end surface of the case in the second region, and wherein the sealing member is spaced from the step end surface of the case in a region between the contact point and the first protrusion.

12. The display device according to claim 1, wherein the light-emitting elements comprise surface-mount LEDs.

13. The display device according to claim 2, wherein the light-emitting elements comprise surface-mount LEDs.

14. The display device according to claim 1, wherein the forward end surface contacts the back surface of the substrate.

15. The display device according to claim 2, wherein the forward end surface contacts the back surface of the substrate.

16. The display device according to claim 1, wherein the light-emitting elements are provided on the front surface of the substrate at an interval of 3 mm to 20 mm.

17. The display device according to claim 2, wherein the light-emitting elements are provided on the front surface of the substrate at an interval of 3 mm to 20 mm.

18. The display device according to claim 1, wherein a part of the sealing member is in contact with the back surface of the substrate, and wherein the light-emitting elements are not provided on the back surface.

19. The display device according to claim 2, wherein a part of the sealing member is in contact with the back surface of the substrate, and wherein the light-emitting elements are not provided on the back surface.

20. The display device according to claim 1, wherein the sealing member is in surface contact with the outer peripheral side surface of the case.

21. The display device according to claim 2, wherein the sealing member is in surface contact with the outer peripheral side surface of the case.

* * * * *